United States Patent [19]

Tramontini

[11] 3,982,587

[45] Sept. 28, 1976

[54] VEHICULAR RADIATOR ASSEMBLY

[75] Inventor: Vernon N. Tramontini, Indianapolis, Ind.

[73] Assignee: Stewart-Warner Corporation, Chicago, Ill.

[22] Filed: Nov. 20, 1974

[21] Appl. No.: 525,355

[52] U.S. Cl. ..... 165/149

[51] Int. Cl.[2] ..... F28F 9/00

[58] Field of Search ..... 165/149, 150, 81, 82; 180/68, 68 R, 70, 70 R; 123/41.54

[56] References Cited

UNITED STATES PATENTS

| | | | |
|---|---|---|---|
| 1,829,777 | 11/1931 | Askin | 165/149 X |
| 1,834,001 | 12/1931 | Modine | 165/81 X |
| 2,488,804 | 11/1949 | Christensen | 165/149 |
| 3,228,461 | 1/1966 | Leeking | 165/81 |
| 3,248,076 | 4/1966 | Ferguson | 180/68 R X |
| 3,614,982 | 10/1971 | Krizman | 123/41.54 |

*Primary Examiner*—Charles J. Myhre
*Assistant Examiner*—Theophil W. Streule, Jr.

[57] ABSTRACT

A vehicular radiator having a core assembly consisting of a plurality of vertical rows of fluid carrying tubes separated by a plurality of rows of fins with the outer fin rows having mounting surfaces connected to side channels so that the core assembly may be suitably supported. To permit free expansion of the fluid carrying tubes and to reduce the supporting stresses for the core assembly, upper and lower header plates are provided carried by the tubes but unconnected to the side channels to permit free relative movement therebetween caused by thermal expansion and contraction. Upper and lower tanks are provided connected to the upper and lower header plates and these have suitable inlet and outlet fittings adapted to be connected to the cooling circuit of an associated engine. As a result of eliminating the supporting requirement for the header and associated tanks, the upper tank may be made smaller than customary, reducing the weight and size of the overall radiator through the provision of an auxiliary reservoir for the upper tank.

2 Claims, 6 Drawing Figures

FIG.4
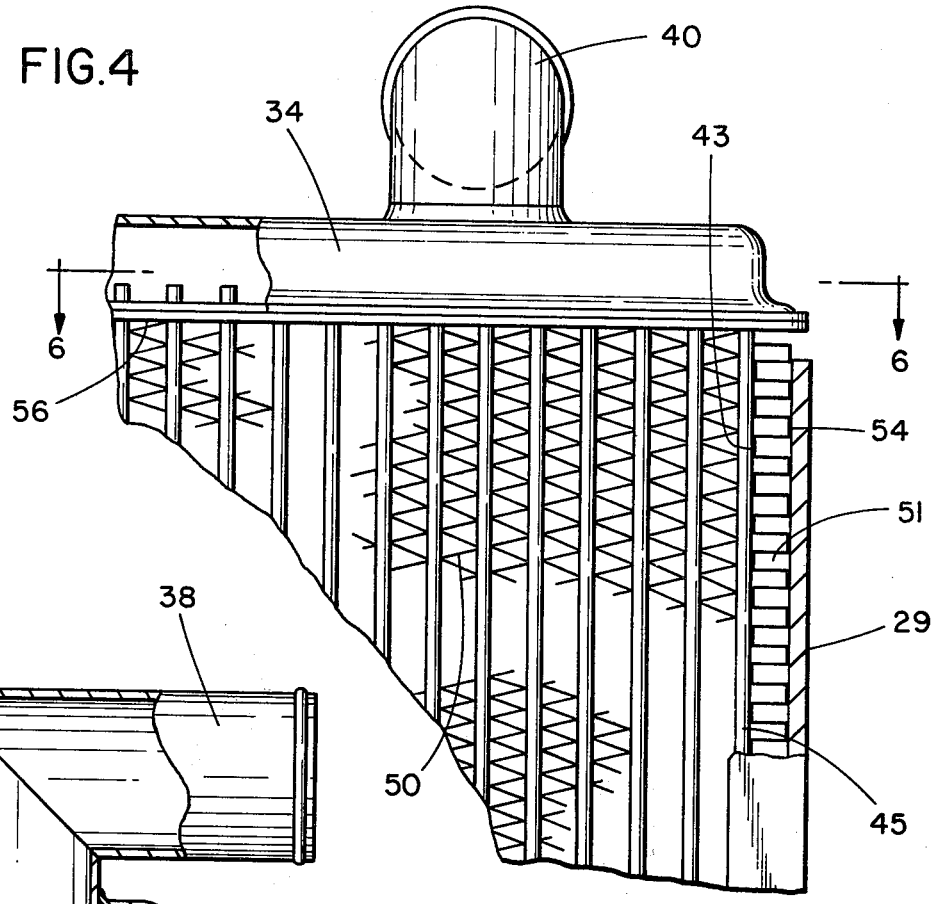
FIG.5
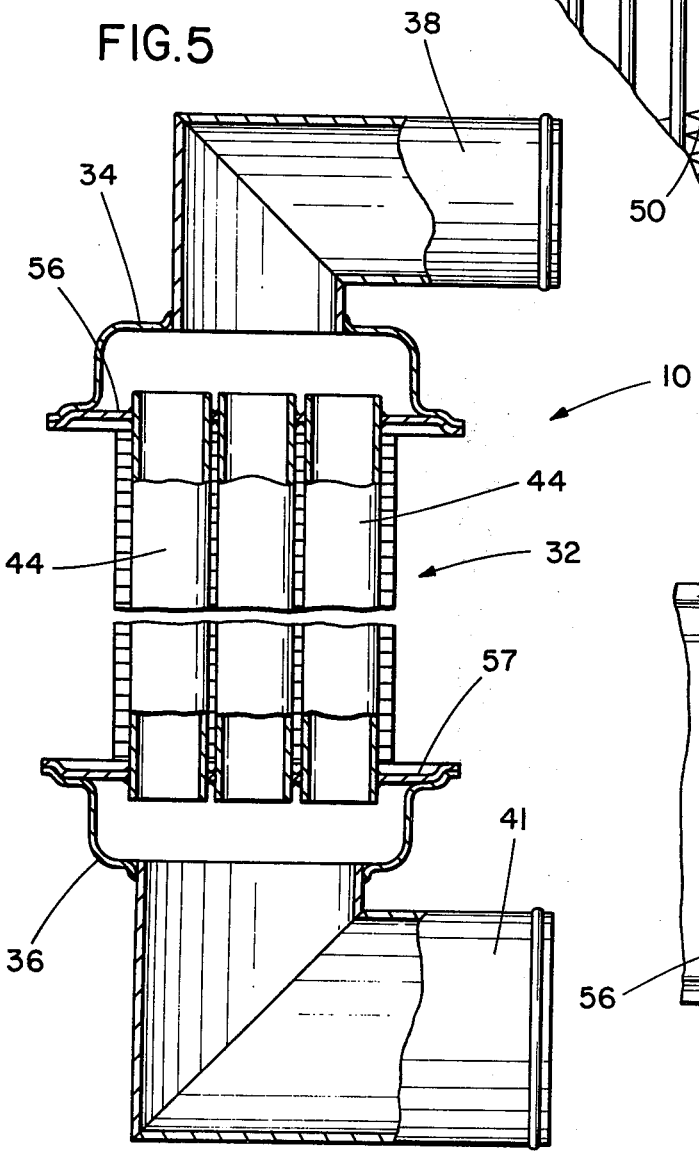
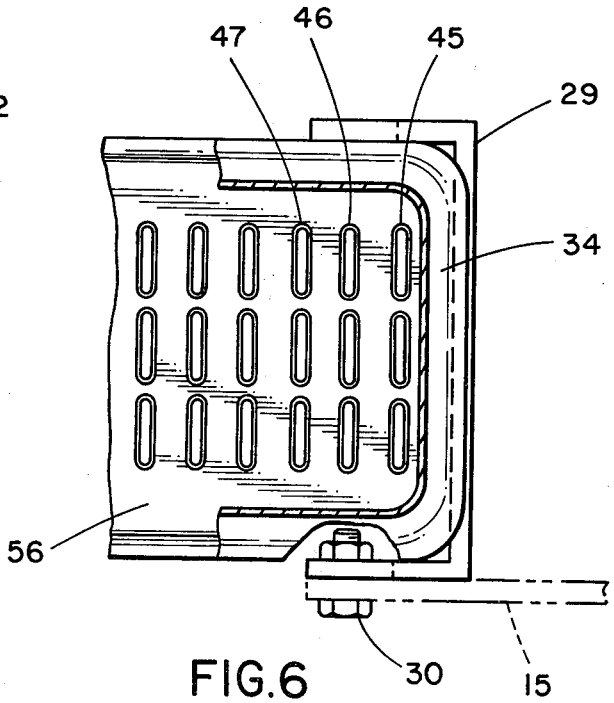
FIG.6

VEHICULAR RADIATOR ASSEMBLY

BACKGROUND OF THE PRESENT INVENTION

The present invention relates to vehicular radiators for the cooling systems of internal combustion engines and more particularly to a vehicular radiator assembly of the planar type. Prior radiator assemblies of this type include a plurality of rows of tubes separated by a plurality of rows of fins. The tubes are connected at the top and bottom to header plates. This comprises the core assembly, and the core assembly is supported on side frame members with the side frame members being connected to the header plates. The side frame members also support heavy tanks communicating with the top and bottom header plates. Thus, the frame assembly in these prior radiator assemblies consists essentially of two side frame members and the upper and lower tanks which must of necessity be of heavy construction.

One problem associated with radiator constructions of this type is that because of the differential thermal expansion between the side frame members and the fluid carrying tubes there exists a stress relationship between the tubes and the header plates. To some extent this differential expansion is compensated for by flexure of the header plates. However, the flexure of the header plates is limited adjacent the end of the plates, and particularly near the first row of fluid carrying tubes in the core assembly. Frequently this problem results in closing off and rendering inoperative the first row of tubes at both sides of the radiator core assembly, and thereby reducing the capacity of the radiator.

Moreover, the problem of differential expansion becomes more acute in radiators having large frontal core areas.

It is the primary object of the present invention to diminish the problems of the prior art.

SUMMARY OF THE PRESENT INVENTION

In accordance with the present invention a reduced weight, higher efficiency vehicular radiator assembly is provided in which the radiator tanks are supported on the core assembly rather than on the side frame members, thereby permitting free differential expansion between the core assembly, header plates, tanks and the side frame members. The radiator assembly, according to the present invention, consists basically of a core assembly supporting both top and bottom tanks, side channel members supporting the core assembly, and a deaerating surge tank communicating with the upper tank. The core assembly consists of a plurality of rows of fluid carrying tubes separated by a plurality of rows of fins with the outer rows of fins having vertical side surfaces adapted to be connected to side channel members. The side channel members are in turn adapted to be connected to the frame of the associated vehicle. The core assembly also includes header plates connected to the tubes and free of the side frame channels to permit free movement of the header during expansion of the core tubes.

Moreover, the drawn sheet metal upper and lower tanks are carried by the header plates and thus are supported by the core assembly rather than the side frame members as in prior constructions. This permits a lightweight upper tank to be provided of less expensive construction with the capacity of the upper tank being increased through the provision of an auxiliary deaerating surge tank communicating therewith.

BRIEF DESCRIPTION OF THE DRAWINGS

FIG. 4 is a fragmentary view of a portion of the radiator assembly according to the present invention with the side channels broken away illustrating the last row of fins;

FIG. 5 is a fragmentary side elevation showing the internal radiator and header tube construction; and FIG. 6 is a fragmentary section taken generally along line 6—6 of FIG. 4.

DETAILED DESCRIPTION OF THE PREFERRED EMBODIMENT

Figure 1:
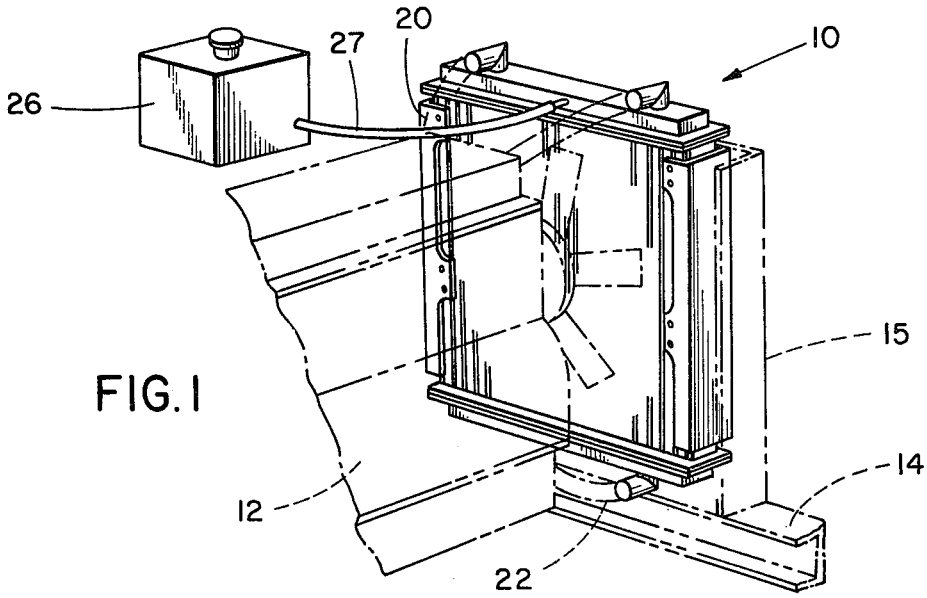
FIG. 1 is a perspective view of a radiator assembly according to the present invention shown in conjunction with a vehicle engine.

Referring to the drawings, a radiator assembly 10 is illustrated; shown in conjunction with an internal combustion engine 12 with horizontal and vertical frame elements 14 and 15. The frame elements 15 support the radiator assembly 10 in position with the vehicle. Hoses 20 convey fluid to the radiator while hose 22 conveys fluid from the radiator back to the engine water pump and from there the fluid flows through the engine cooling jacket, as is well known in the art.

A deaerating surge tank 26 is provided communicating with the radiator through flexible conduit 27 for the purpose of increasing the upper tank capacity of the radiator 10 and permitting a reduction in the weight of the upper tank.

Figure 2:
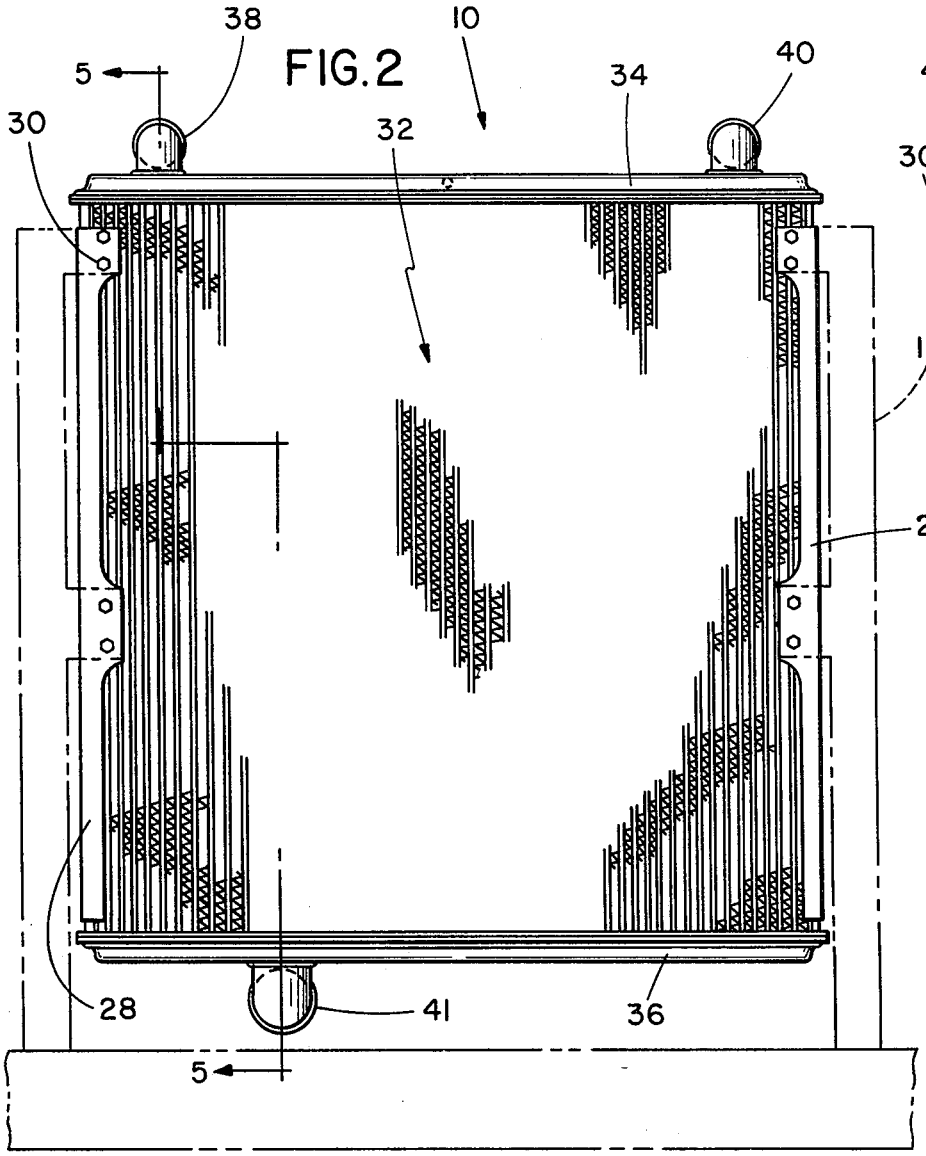
FIG. 2 is an enlarged front elevation of a radiator assembly according to the present invention.
Figure 3:
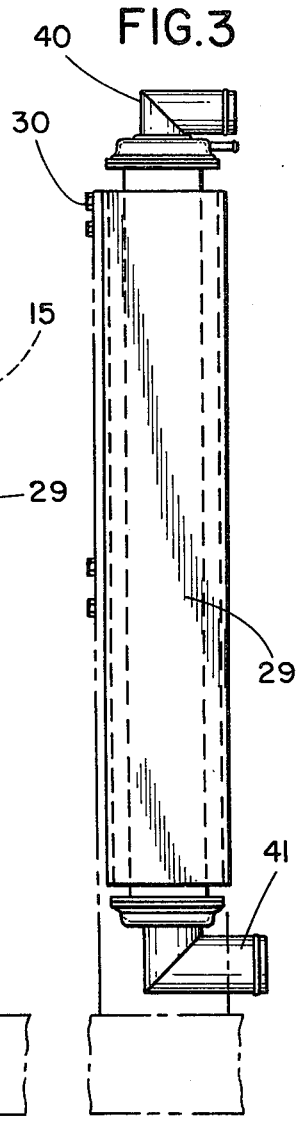
FIG. 3 is a side elevation of a radiator assembly according to the present invention.

As seen in FIGS. 2 and 3, radiator assembly 10 is seen to include side channel members 28 and 29 having fasteners indicated at 30 for the purpose of connecting the side channel members 28 and 29 to the vehicular frame members 15.

A core assembly 32 is provided which independently supports an upper tank 34 and a lower tank 36. The upper tank 34 has right angle inlet fittings 38 and 40, while the lower tank 36 has right angle outlet fitting 41 as seen clearly in FIGS. 2 and 3. The inlet fittings 38 and 40 are adapted to be connected to inlet hoses 20 while the outlet fitting 41 is adapted to be connected to outlet hose 22, as seen more clearly in FIG. 1.

As seen more clearly in FIGS. 4, 5 and 6, the core assembly includes a plurality of rows of generally oblong fluid-carrying heat exchange tubes 44. As seen more clearly in FIG. 6, there are provided in radiator assembly 10, rows of tubes such as at 45, 46 and 47. Separating the rows of tubes are fin plates 50 brazed to the tubes 44. The core assembly 32 is provided with outer fin plates 51 being of a zig-zag construction having generally vertical mounting surfaces 53 and 54. Surfaces 54 are brazed to the side channels 28 and 29 while the surfaces 53 are brazed to the first tube row 45, as seen in FIG. 4. In this manner the side channels 28 and 29 support the core assembly 32.

Also included in the core assembly 32, and as seen in FIGS. 4, 5 and 6 are a generally rectangular upper header plate 56 and an identical lower header plate 57. The header plates 56 and 57 have apertures which receive tubes 44 and are brazed to the tubes providing the proper sealing engagement therewith.

The upper and lower tanks 34 and 36 are preferably drawn sheet metal and are brazed or welded to the upper and lower header plates 56 and 57. It should be noted that both the tanks 34 and 36, as well as header plates 56 and 57, are completely unconnected to the side channel members 28 and 29 and thus may have a free movement with respect thereto resulting from the differential thermal expansion of the fluid carrying heat exchange tubes 44 and the side channels 28 and 29.

To reduce the weight of the upper tank 34, since it is supported by the core assembly 32, the tank is made smaller and the deaeration surge tank 26 is provided to increase the capacity of the upper tank 34.

What is claimed is:

1. A radiator assembly, comprising; a core assembly including a plurality of rows of fluid carrying tubes, a plurality of rows of fins separating said fluid carrying tubes and including outer fin rows at each side of the core assembly, said outer fin rows having generally vertical mounting surfaces, side frame channel members engaging and connected to the mounting surfaces at each side of the core assembly frame elements connected to and supporting said frame channel members, header plates fixed to the upper and lower ends of the fluid carrying tubes, said header plates being completely unconnected to, out of contact with, and vertically spaced from said side channel frame members to permit free relative expansion and contraction movement therebetween, an upper tank fixed to said upper header plate, said upper tank being unconnected to the side frame members so that the upper tank is supported by said core assembly, an inlet fitting communicating with said upper tank, a lower tank fixed to said lower header plate, said lower tank being unconnected to said side frame members so that the lower tank is supported by said core assembly, and an outlet fitting communicating with said lower tank.

2. A radiator assembly as defined in claim 1, wherein said upper tank is a lightweight low capacity tank, and a separate reservoir communicating with said upper tank to increase the capacity thereof.

* * * * *